US005102383A

United States Patent [19]

Achelpohl et al.

[11] Patent Number: 5,102,383

[45] Date of Patent: Apr. 7, 1992

[54] METHOD OF MANUFACTURING A SACK OR BAG WITH A BOTTOM BEING RECTANGULAR IN THE FILLED STATE AND A HANDLE PORTION JOINED THERETO

[75] Inventors: Fritz Achelpohl; Werner Jürgens, both of Lengerich, Fed. Rep. of Germany

[73] Assignee: Windnoller & Holscher, Lengerich, Fed. Rep. of Germany

[21] Appl. No.: 695,649

[22] Filed: May 7, 1991

[30] Foreign Application Priority Data

May 7, 1990 [DE] Fed. Rep. of Germany ..... 4014600

[51] Int. Cl.[5] ..... B31B 31/86

[52] U.S. Cl. ..... 493/226; 493/218; 493/926; 493/936

[58] Field of Search ..... 493/218, 221, 226, 228, 493/231, 243, 261, 926, 936

[56] References Cited

U.S. PATENT DOCUMENTS

| | | | |
|---|---|---|---|
| 2,845,849 | 8/1958 | Hahn | 93/14 |
| 3,021,767 | 2/1962 | Hamilton | 493/221 |
| 3,081,674 | 3/1963 | Steen | 493/226 |
| 3,237,534 | 3/1966 | Lissner | 493/218 |
| 3,272,093 | 9/1966 | Brockmuller | 493/218 |
| 3,397,622 | 8/1968 | Goodwin | 493/218 |
| 3,605,570 | 9/1971 | Goodwin | 493/226 |
| 3,611,883 | 10/1971 | Grob | 493/221 |

FOREIGN PATENT DOCUMENTS

| | | |
|---|---|---|
| 8516469 | 8/1985 | Fed. Rep. of Germany . |
| 440107 | 12/1967 | Switzerland . |

*Primary Examiner*—William E. Terrell

*Attorney, Agent, or Firm*—Fleit, Jacobson, Cohn, Price, Holman & Stern

[57] ABSTRACT

A method for manufacturing a sack or bag with a bottom being rectangular in the filled state and a handle portion joined thereto. An economical method for production by machine, according to the invention includes the following steps carried out sequently. A flattened tube piece (10) is provided with two slits at one end. The slits are substantially parallel to each other and to the lateral edges of the tube. Then a bottom square is formed by folding the tube piece near the slit end with corner tucks (14) and side tucks (16, 18). A prefabricated handle portion (22), including a reinforcing strip (24) and a connection strip (26) is glued or welded such that an edge portion (20) of one side tuck (16) is not covered by the prefabricated handle portion. Subsequently, such side tuck (16) and the corner tucks (14) are folded along a fold line (28) extending through the center of the corner tucks (14) and the uncovered edge portion (20) is glued or welded to the corresponding adjacent section of the handle portion. Finally a griphole cut (36) is punched in reinforcing section (24).

6 Claims, 5 Drawing Sheets

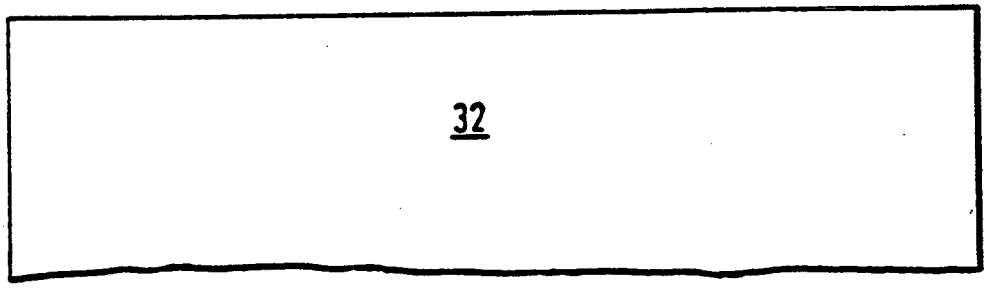
Fig.8
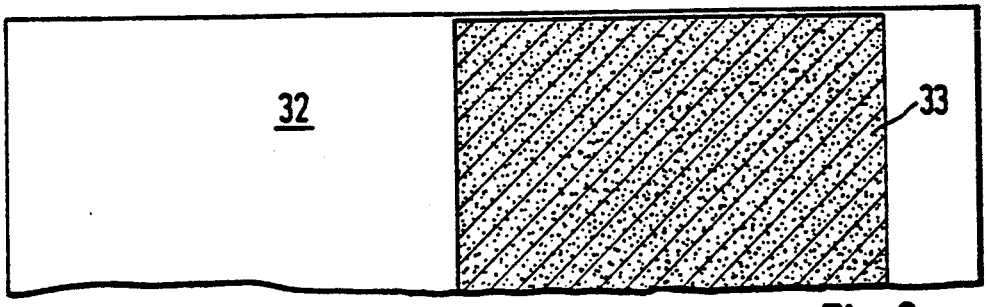
Fig.9
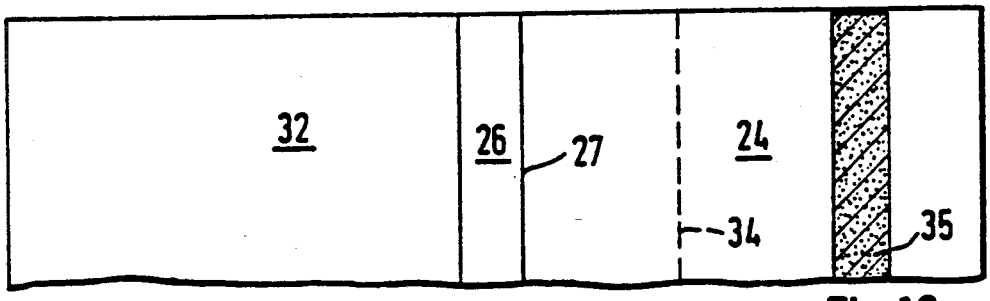
Fig.10
Fig.10a
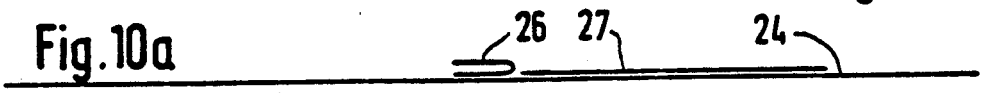
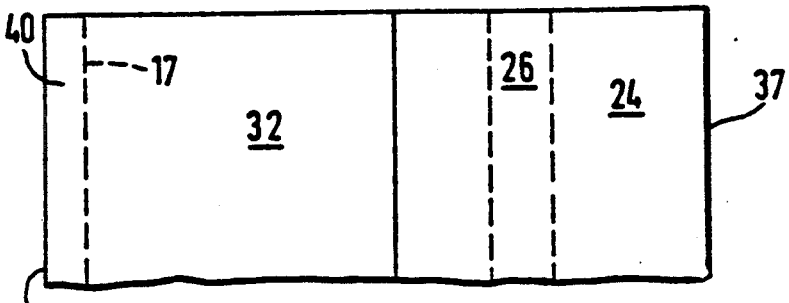
Fig.11
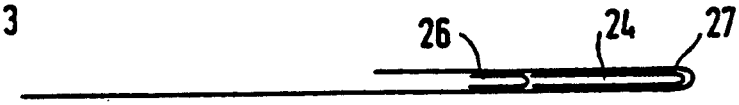
Fig.11a

METHOD OF MANUFACTURING A SACK OR BAG WITH A BOTTOM BEING RECTANGULAR IN THE FILLED STATE AND A HANDLE PORTION JOINED THERETO

FIELD OF THE INVENTION

This invention relates to a method for manufacturing a sack or bag with a bottom being rectangular in the filled state and a handle portion joined thereto.

BACKGROUND

Sacks or bags of this kind are known from the German Utility Models 81 15 909 and 82 07 889. German patent application P 40 12 896.2 discloses a sack or bag which is formed by side tucks partially overlapping corner tucks. A handle portion having a middle web section with the griphole and lateral leg-like strips of flexible sheet material is connected to the tucks to form a bottom.

It has been proved to be disadvantageous that the sack or bag described in application P 40 12 896.2 cannot be easily and simply produced by machine.

SUMMARY OF INVENTION

It is an object of the invention to provide a method for manufacturing an improved sack or bag with reduced strains when carryed by the handle and which can be easily and economically produced by machines in a production line.

Embodiments of the invention will be described with reference to the following drawings.

BRIEF DESCRIPTION OF THE DRAWING

FIG. 8 to 11 are schematical representations, partially as top plan views, partially as cross-sectional views showing steps for manufacturing the handle portion.

DETAILED DESCRIPTION OF PREFERRED EMBODIMENTS

Figure 1:
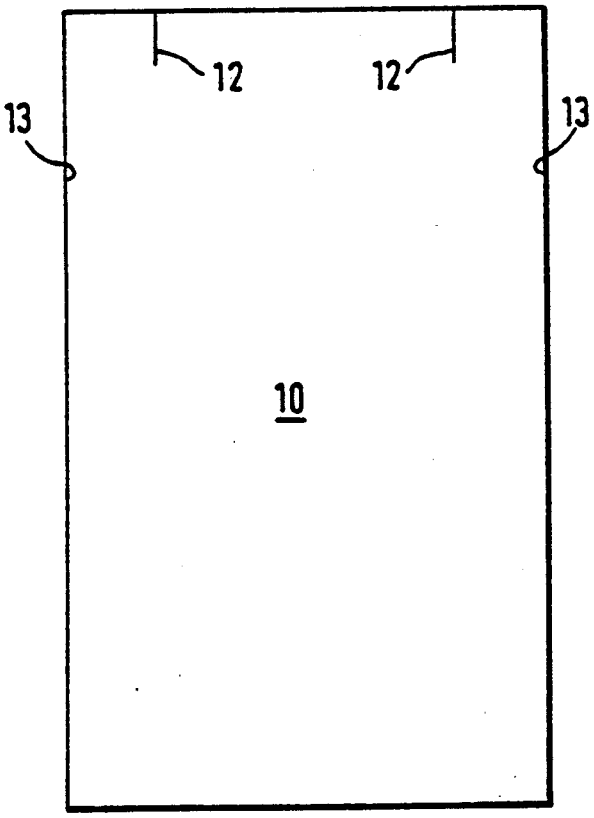
FIG. 1 is a top plan view of a tube portion in the flat state, severed from a tubular web.

FIG. 1 shown a flattened tube portion 10 severed from a tubular web of paper or thermoplastic synthetic resin. Two slits 12 are formed at one end of tube portion 10. The slits are parallel to each other and lateral fold edges 13. The length of each slit being nearly the same as the distance between the slit and a lateral fold edges 13.

Figure 2:
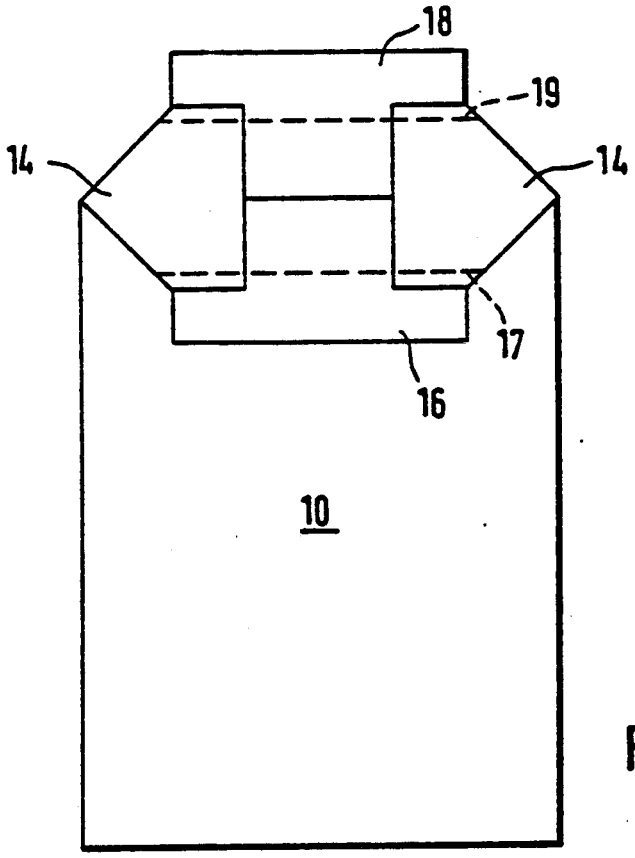
FIG. 2 shows the portion according to FIG. 1 folded to form a bottom square with side and corner tucks.

FIG. 2 shows the sack workpiece according to FIG. 1 with one end folded to form a bottom square with corner tucks 14 and side tucks 16 and 18. The side tucks 16, 18 are partially separated from the corner tucks 14 by the cutting lines 12. Side tucks 16, 18 are folded at lines 17, 19 after filling of the sack.

Figure 3:
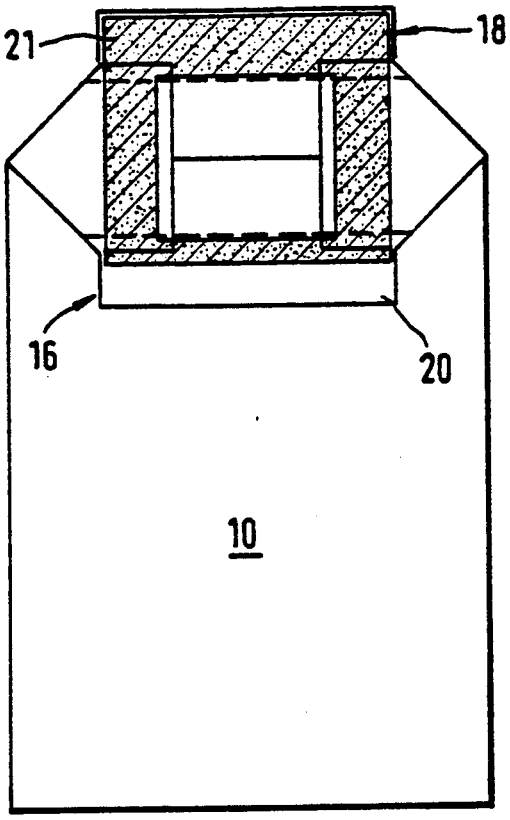
FIG. 3 shows the portion according to FIG. 2 showing a layer of glue spread over the bottom square.

Over the so-called bottom square, a glue layer 21 is spread as suggested in FIG. 3 by hatched portions. At the lower side tuck 16, an edge section 20 is kept free of glue.

Figure 4:
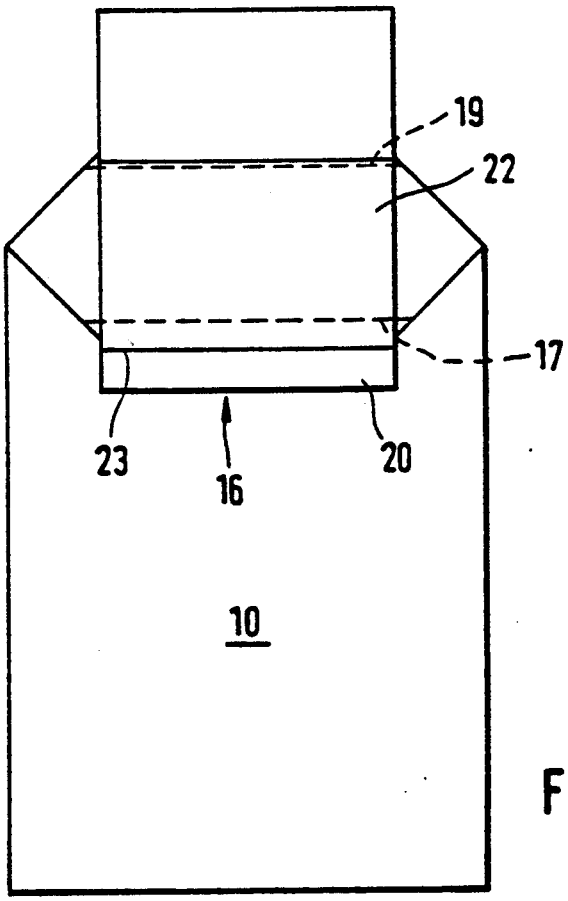
FIG. 4 shows portion according to FIG. 3 with a handle portion glued to the bottom square.

A prefabricated handle portion sheet 22, is glued to the bottom square as shown in FIG. 4. Line 23 corresponds to the lower outer edge of the handle portion sheet 22. The edge section 20 of the lower side tuck 16 is not covered by the handle portion sheet 22.

Closing and sealing of the bottom is achieved by gluing or welding of the bottom square with the handle portion sheet 22.

Prefabrication of the handle portion sheet utilizes web 32 of paper or synthetic resin foil. The uneven line in FIGS. 8–11*a* suggests that the web can have any length. Over this web glue layer 33 is continuously spread on area 33 of the web as represented by hatched portions in FIG. 9. Two strips are continuously glued to area 33. The first strip constitutes a reinforcing section 24. The second strip is folded laterally to form a pair of connected leaves and a first leaf is glued to web 32. The strips 24 and 26 are glued to web 32 in position directly adjacent to each other. The fold edge 27 of web 26 is directly adjacent to the reinforcing section 24. The arrangement of the reinforcing strip 24 and strip 26 is shown in the top plan view according to FIG. 10 and the cross-sectional view according to FIG. 10*a*. The part of glue area 33 which is not covered by strips 24 and 26 is designated by the reference numeral 35 in FIG. 10.

The web prepared and composed according to FIG. 10 is folded at the fold line 34, which laterally bisects strip 24 and is pregrooved if required. The folding forms a fold edge 37 in FIG. 11 and permits area 35 of web 32 to be glued to the second leaf of folded strip 26 to connect the two leaves of the folded web. FIG. 11*a* shows a cross-sectional view of the web which is then cut laterally by a blade to form handle portion 22.

Figure 5:
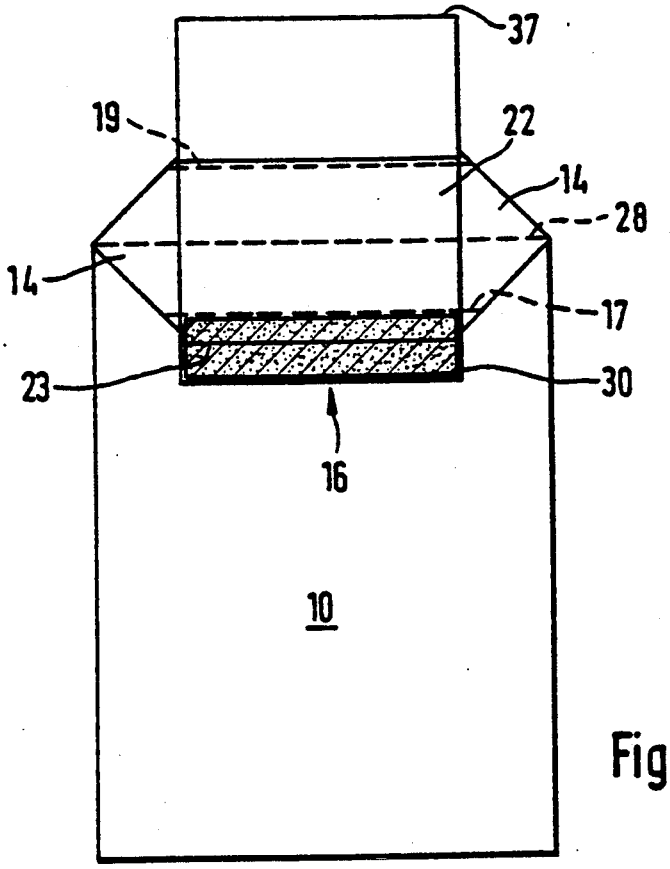
FIG. 5 is a representation according to FIG. 4 showing glue spread on an edge section.

Subsequent to the gluing of the handle portion to the bottom square, an edge zone 30 as shown by hatching in FIG. 5 is spread with glue. The edge zone comprises the edge section 20 (see FIG. 4) of the side tuck 16 and preferrably includes an edge section 40 (see FIG. 11) of the handle portion 22, between the outer sheet edge line 23 and the fold line 17.

Figure 6:
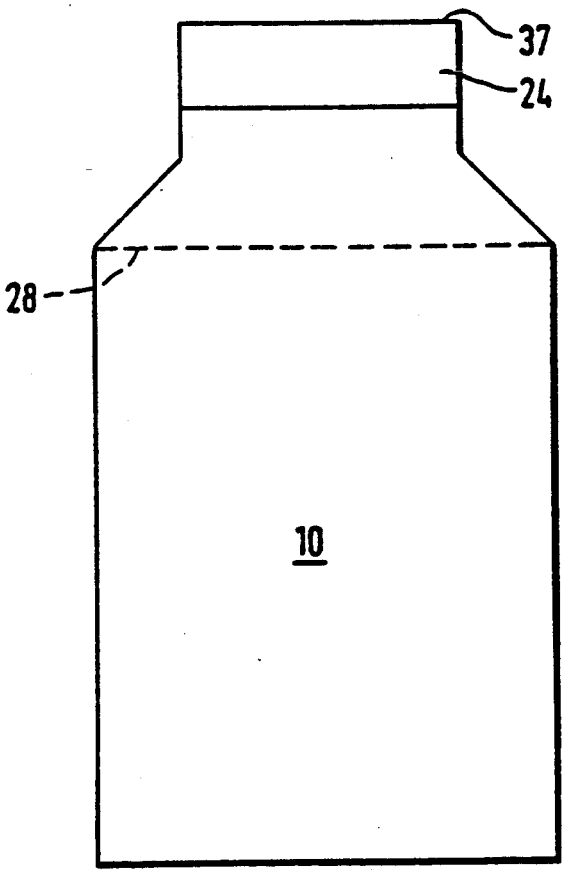
FIG. 6 is a top plan view of the bottom folded upwards.

Then the side tuck 16 in FIG. 5 together with the half corner tucks 14 are folded along fold line 28, extending through the tops of the corner tucks 14, so that edge zone 30 can be glued to the corresponding surface of the handle portion sheet 22. A flat sack according to FIG. 6 is obtained.

Figure 7:
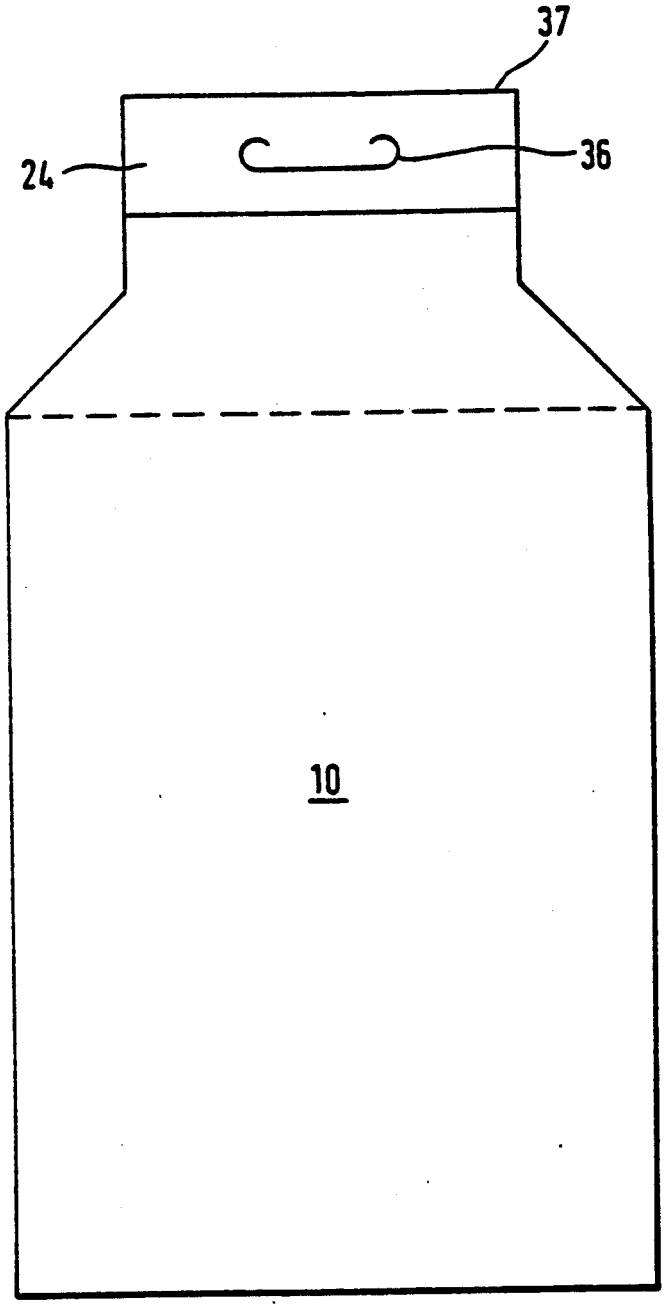
FIG. 7 is a representation according to FIG. 6, illustrating the handle portion punched with a griphole cut.

Subsequently, the corresponding grip hole cut 36 (see FIG. 7) is preferably punched in the reinforcing section 24.

Alternatively, the steps which describe gluing may be performed utilizing welding or a combination of welding and gluing.

We claim:

1. Method for manufacturing a sack or bag with a bottom being rectangular in the filled state and a handle portion joined thereto, including the following steps:

a) providing a tubular sheet flattened to form two layers longitudinally connected at fold edges and having two slits at one end of the tubular sheet, such slits extending through both layers and being substantially parallel to each other and to the lateral fold edges;

b) folding the slit end for forming two corner tucks and two side tucks;

c) gluing or welding a prefabricated handle portion to such tucks, such handle portion including a reinforcing strip and a connecting strip, such that an edge portion of one side tuck is not covered by the prefabricated handle portion;

d) folding the side tucks and corner tucks along a fold line extending through the center of the corner tucks and together so that the uncovered edge portion is adjacent to the distal edge of the handle portion; and e) gluing or welding the uncovered edge portion to the adjacent edge section of the handle portion.

2. Method according to claim 1, wherein the handle portion is produced by the following steps:

a) gluing or welding a reinforcing strip and one leaf of a laterally folded connection strip to one side of a web;

b) folding the web laterally approximately through the center of the reinforcing strip to envelop the two strips between adjacent leaves of the web; and c) gluing or welding the other leaf of the folded strip to the adjacent leaf of the web.

3. Method according to claim 2, further including the step:

slightly slitting or grooving the reinforcing strip for folding the web.

4. Method according to claim 1, further including the step:

punching the handle portion subsequent to step e) of claim 1 to form a grip hole cut.

5. Method according to claim 2, further including the step:

punching the handle portion subsequent to step e) of claim 1 to form a grip hole cut.

6. Method according to claim 3, further including the step:

punching the handle portion subsequent to step e) of claim 1 to form a grip hole cut.

* * * * *